US008292599B2

(12) United States Patent
Lifson et al.

(10) Patent No.: US 8,292,599 B2
(45) Date of Patent: Oct. 23, 2012

(54) COMPRESSOR REVERSE ROTATION OF VARIABLE DURATION ON START-UP

(75) Inventors: Alexander Lifson, Manlius, NY (US); Jason Scarcella, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 286 days.

(21) Appl. No.: 12/530,486

(22) PCT Filed: Mar. 13, 2007

(86) PCT No.: PCT/US2007/063837

§ 371 (c)(1), (2), (4) Date: Dec. 22, 2009

(87) PCT Pub. No.: WO2008/111976

PCT Pub. Date: Sep. 18, 2008

(65) Prior Publication Data

US 2010/0092306 A1 Apr. 15, 2010

(51) Int. Cl.
*F04B 17/00* (2006.01)
*F04B 35/00* (2006.01)

(52) U.S. Cl. ..... 417/325; 417/12; 417/14; 417/410.4; 418/55.1

(58) Field of Classification Search ..... 417/12, 417/13, 14, 410.3, 410.4, 410.5, 325; 418/55.1, 418/55.2–55.6, 1
See application file for complete search history.

(56) References Cited

U.S. PATENT DOCUMENTS 5,518,373 A * 5/1996 Takagi et al. ..... 417/45
6,648,604 B1 * 11/2003 Lifson ..... 417/53
6,848,268 B1 2/2005 Memory et al.
7,290,990 B2 * 11/2007 Lifson ..... 417/53
2003/0194330 A1 * 10/2003 Lifson ..... 417/325
2005/0103036 A1 * 5/2005 Maekawa ..... 62/228.1
2005/0146221 A1 * 7/2005 Pettigrew ..... 307/64
2005/0235661 A1 * 10/2005 Pham ..... 62/126

FOREIGN PATENT DOCUMENTS

CN 1864037 11/2006

OTHER PUBLICATIONS

International Search Report mailed Sep. 24, 2008 (2 pgs.).
International Preliminary Report on Patentability issued Sep. 15, 2009 (4 pgs.).

* cited by examiner

*Primary Examiner* — Charles Freay
*Assistant Examiner* — Christopher Bobish
(74) *Attorney, Agent, or Firm* — Cantor Colburn LLP

(57) ABSTRACT

In a method of operating a compressor at startup, the compressor is rotated in reverse for a brief period of time. The compressor is of a type that does not compress liquid when rotated in reverse. The purpose is to boil off the liquid refrigerant from the oil by heating and agitating the mixture of oil and refrigerant in the oil sump. This results in a much more benign forward start as less refrigerant is drawn into the compressor pump and the amount of oil pumped out of the compressor on start up is minimized. Also, the viscosity of oil is increased and lubrication of the bearings is improved. After a short period of time reverse rotation is stopped and the compressor can start rotating in the forward direction. The short period of time of reverse rotation is varied based upon system conditions. In one embodiment, the variation can occur by reducing the reverse run time as ambient temperature increases. In another embodiment, electrical conditions such as incoming voltage and/or a ratio of voltage to frequency can be utilized to change the reverse run time.

28 Claims, 3 Drawing Sheets

COMPRESSOR REVERSE ROTATION OF VARIABLE DURATION ON START-UP

BACKGROUND OF THE INVENTION

This invention relates to a unique method of minimizing the detrimental effect of compressor flooded starts by running the compressor in reverse for a variable period of time.

A scroll compressor is one type compressor widely utilized in refrigerant compressor operation. One known type of scroll compressor includes compression elements and an electric motor housed within a sealed compressor shell. A quantity of lubricant is also received in the compressor shell. In such compressors, the refrigerant passes over the motor on its way to the inlet of the compression elements, cooling the motor.

In a scroll compressor a pair of scroll members have wraps which interfit with each other to define compression chambers. When rotated in a forward direction, a normal compression process occurs in which refrigerant is trapped between the wraps and compressed towards a discharge port.

At startup, oil located in a compressor sump, may contain a quantity of liquid refrigerant. At startup the sump and motor are cool, and preheating does not occur. The presence of the non-preheated oil/refrigerant mixture in the oil sump has undesirable effects.

The problem is particularly acute in refrigerant systems for intermodal transport, here refrigeration takes place in large containers used to transport fruit or other food products over long distances. Inter-modal refrigerant containers may be initially shipped on a boat, transferred to a train, and then transferred to trucks. Refrigeration must be maintained throughout the entire trip. The container may then be returned to a remote location for storage. Thus, during its life cycle a container refrigeration system may often be shut down for long periods of time.

The problem can become especially severe during cold starts. When the refrigeration system is shut down, under certain ambient conditions, large portions of liquid refrigerant contained in the system can migrate to the compressor sump. Thus oil located in the compressor sump can be diluted with liquid refrigerant. This is undesirable because on startup it can result in liquid refrigerant passing through the scroll elements. This can result in bearing and scroll element damage. Also oil dilution by the refrigerant may lead to lower lubricant viscosity, which is also detrimental to bearing life.

It is known for a scroll compressor to be operated in reverse at startup. See U.S. Pat. No. 6,648,604. When operated in reverse, the refrigerant is not compressed and is not moved through the compression elements. Thus, motor heat is not removed by refrigerant vapor. The motor is immersed in the oil/refrigerant mixture and thus quickly heats this mixture. Refrigerant trapped in the sump is then boiled off and oil temperature is increased.

Additional boiling off of refrigerant takes place as the oil/refrigerant mixture has been agitated by the electric motor rotor and rotor counterweight, rotating in the oil/refrigerant mixture. After a short period of time reverse rotation is stopped, and the motor is rotated in a forward direction and normal compression begins. However, the oil is now preheated and there is less liquid refrigerant in the oil.

The technique above has been used with scroll compressors, and can also be applied to other compressor types such as for example screw compressors.

The severity of the flooded start is greatly minimized by increasing the time of the reverse run. However, increasing this time can cause undesirable overheating of the compressor components, as almost all the heat generated by the motor in reverse run is dissipated within the compressor shell. This problem is especially acute at high ambient condition, when the overheating occurs quickly (15 to 25 seconds). In this case, the compressor might trip an internal line break (which is undesirable, since the compressor will not be able to start up on demand) and/or compressor reliability is sacrificed as generated heat can damage motor laminations and score scroll elements. A similar situation also may occur if on start up the compressor motor was voltage falls below the optimal voltage. In such a case, undesirable overheating may also occur.

Therefore a need exists to further optimize the reverse run operation at conditions when overheating is likely when the compressor runs in reverse.

SUMMARY OF THE INVENTION

In a disclosed embodiment of this invention, a compressor is rotated in reverse at start-up for a length of time that is selected and varied dependent on conditions. In one disclosed embodiment, the condition which causes the variation in the reverse rotation time is the ambient temperature. Ambient temperature ranges may be identified, and incremental changes in the reverse rotation time may be set with respect to the ambient temperature ranges. Alternatively, some formula that continuously varies the reverse rotation time with a continuous variation in temperature can be set.

Other conditions, such as line voltage and/or a voltage/frequency ratio can be utilized to vary the reverse rotation time. As voltage decreases, current increases which increases the potential to trip on an internal motor line break. Thus decreasing operating voltage would result in a decreased reverse run time.

These and other features of the present invention can be best understood from the following specification and drawings, the following of which is a brief description.

DETAILED DESCRIPTION OF THE PREFERRED EMBODIMENTS

Figure 1:
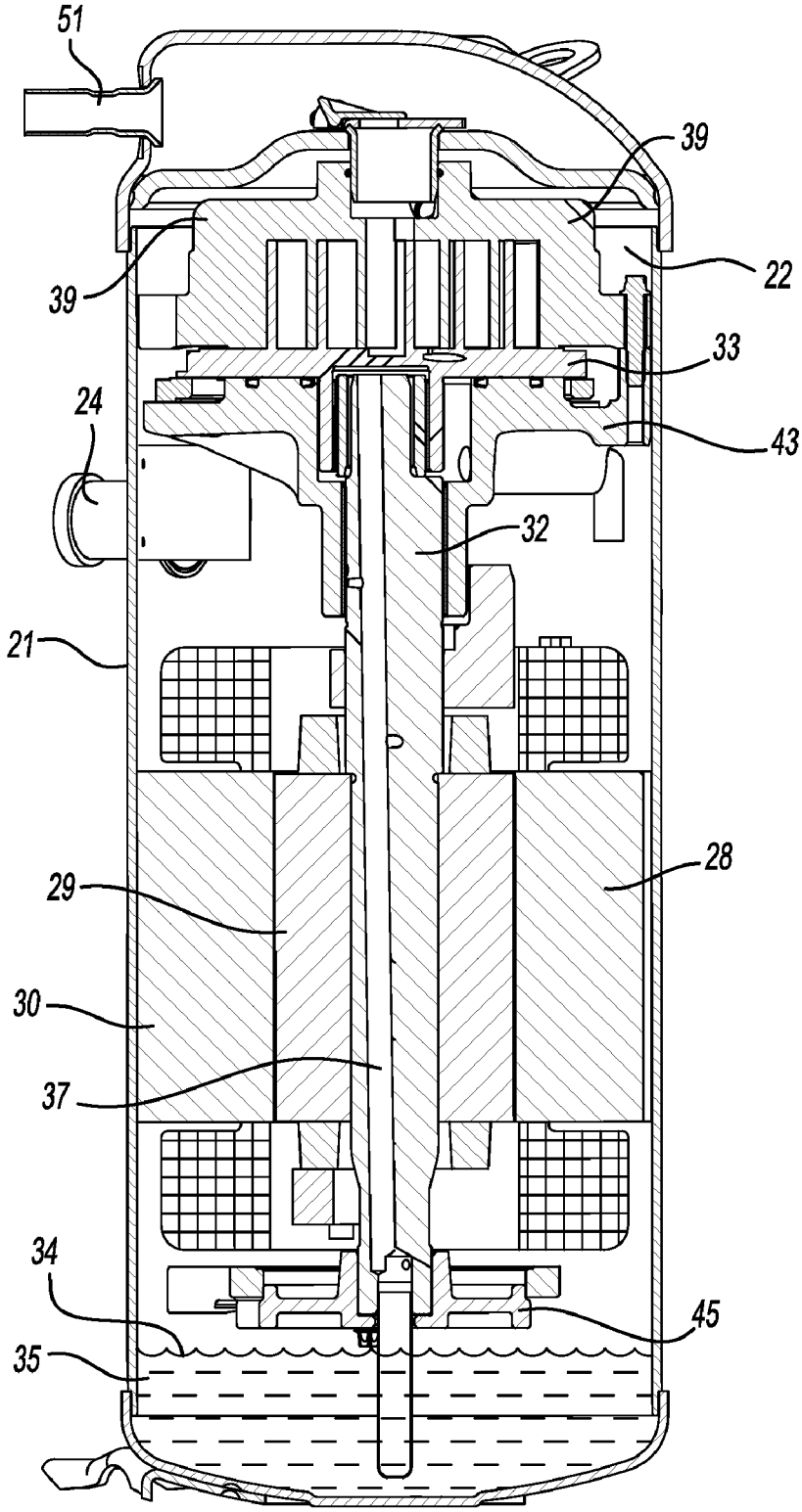
FIG. 1 is a view of the scroll compressor incorporated into the present invention.

FIG. 1 shows a compressor 20 for practicing the present invention. As shown, a sealed compressor shell 21 receives a compressor pump unit 22 consisting of fixed scroll 39, orbiting scroll 33, and crankcase 5. An outlet 51 is formed at a location sealed from the inlet 24. A motor 28 is positioned in the sealed compressor shell 21, and has its rotor 29 spaced from its stator 30. The motor drives a shaft 32 which in turn drives the orbiting scroll 33 of a scroll compressor.

As shown, oil 34 fills the oil sump 35 and the bottom of rotor 29 and shaft 32 rotate within the oil sump. As known, oil travels up a passage 37 within the shaft 32 to lubricate bearings, and fixed 39 and orbiting scroll 33. The fixed scroll is supported by crankcase 43 and the shaft is supported axially by lower bearing ring 45.

During normal operation, the rotor and shaft rotate in a forward direction and the scroll compressor compresses fluid. Fluid enters the compressor shell 21 through inlet 24 and part of the fluid passes over the motor preheating the gas leading into the inlet of the compressor. Another portion of the fluid is delivered directly to the compressor pump 22. The compressor as described until now is as known in the prior art.

Figure 2:
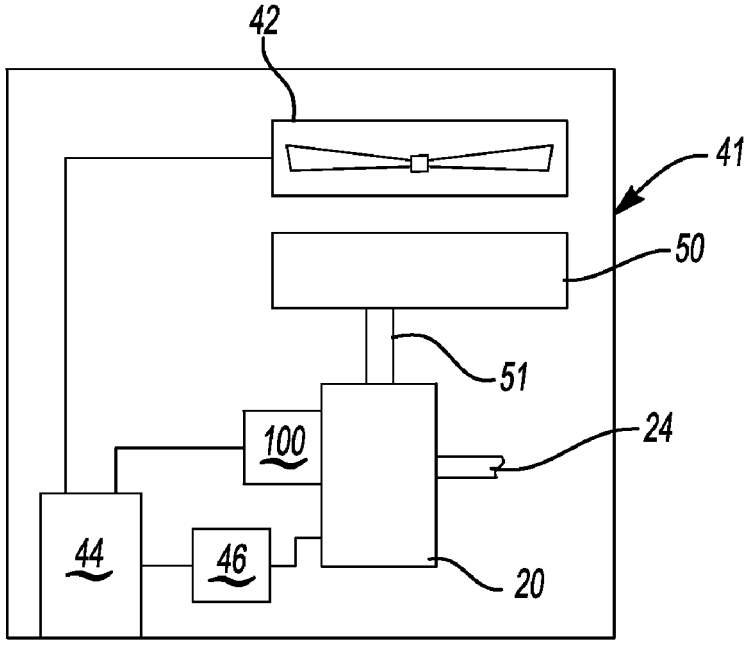
FIG. 2 is a schematic view of a refrigerated container.

FIG. 2 shows a front view of refrigeration system 41 which may be utilized for intermodal refrigerated transportation The refrigerant system 41 includes a fan 42, compressor 20, and condenser 50 connected to compressor discharge line 51. A control 44 controls the fan and compressor motor. Further, the control communicates with a known phase reversing unit 46 which is capable of reversing the phase of the power input to the motor to result in reverse rotation. Other methods of achieving reverse rotation may also be utilized.

Upon startup of compressor 20, the oil 34 may include a relatively large amount of liquid refrigerant. In addition oil 34, and motor 28 are both relatively cool.

When the compressor is started in a forward direction, without being run prior to this in reverse direction, suction pressure decreases rapidly and foaming of the refrigerant and oil mixture occurs. This results in a liquid mixture of refrigerant and oil being ingested with incoming vapor into the compressor pump unit 22. The ingestion of liquid into pump unit 22 can lead to damage to the scroll compressor wraps. Also, oil pump out from the sealed compressor shell can occur, as the mixture of oil and refrigeration may leave the compressor. That is, the amount of oil can be partially depleted. This can result in bearings and scroll compressor wrap damage due to lack of lubrication upon startup.

In the existing system, when it is desired to start the compressor; the control 44 begins to operate motor 28 in reverse. When the orbiting scroll member moves in reverse relative to the fixed scroll member, fluid is not compressed and the mixture of oil and refrigerant is not drawn into pump unit 22. In addition, during reverse rotation, torque is much less than if the liquid is passing through the pump elements. Thus, the pump elements are not overstressed, bearing loads, coupling loads and flank loads are minimal, and wear of components at startup is minimized. Thus, there is no ingestion of the liquid mixture and no damage done to scroll compressor wraps. The oil also stays in the compression sump. Refrigerant vapor is not being driven through the compressor, as no refrigerant is being pulled into the inlet 24. The motor is thus not cooled by incoming refrigerant gas and heats up quickly.

The heat generated by the motor is dissipated into the oil sump and causes oil 34 to quickly heat up. This causes refrigerant in the oil to boil off. Boiling off of refrigerant from the oil is additionally enhanced by agitating the mixture of oil and refrigerant by rotor and shaft rotation in the mixture. After a short transient period of reverse rotation (such as on the order of 15 seconds to four minutes) reverse rotation is stopped. In fact, in many systems the fans are turned on a short period of time (i.e. 45 seconds) prior to compressor start up in the forward direction. Thus, the compressor reverse rotation can occur during the fan startup. Thus, the reverse rotation may not delay refrigerant system startup at all. After completing the reverse rotation, rotation in the forward direction may then begin.

When the rotation in forward direction begins, shortly after the compressor has been operated in reverse, there is much less liquid refrigerant in the oil than would have been if no prior reverse rotation has taken place. Thus the mixture of oil and refrigerant is not drawn into the pump unit and the oil does not leave the compressor shell case. Also as a substantial amount of refrigerant has been boiled off from the oil, the viscosity of the oil is increased, which is beneficial to bearing lubrication. Thus potential damage to compressor is minimized. Further, it may only be necessary to use reverse rotation under certain conditions. As an example, reverse rotation may only be necessary when shut down time exceeds a minimum value. Prolonged operation of the scroll compressor in reverse can lead to motor and scroll wrap damage due to overheating. In the existing system, no reverse rotation may be necessary if the ambient temperature is above a predetermined limit.

Figure 3:
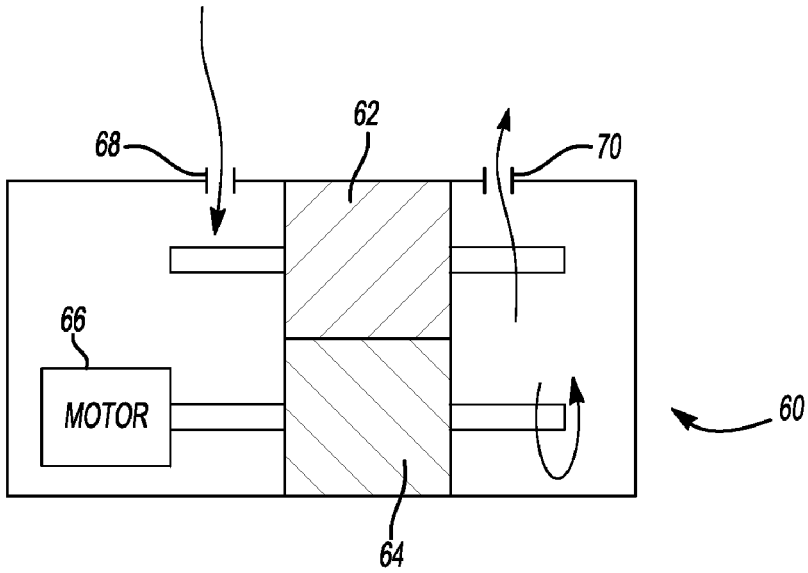
FIG. 3 is a view of a screw compressor.

FIG. 3 shows a screw compressor 60 schematically. As known, a pair of intermeshed screw rotors 62 and 64 defines compression chambers. A motor 66 drives one of the screw compressor elements 64. An inlet or suction line 68 delivers a refrigerant which is compressed by the intermeshing screws 62 and 64 and which is delivered to an outlet 70. This type of compressor is generally similar to a scroll compressor in that there is not effective compression when the rotor is driven in a reverse direction. Thus, it is atypical and contrary to standard screw compressor design to drive the compressors in anything other than its normal operational direction. However, within the context of the above process, some short driving in the reverse direction is utilized for the benefit similar to those discussed above.

Figure 4:
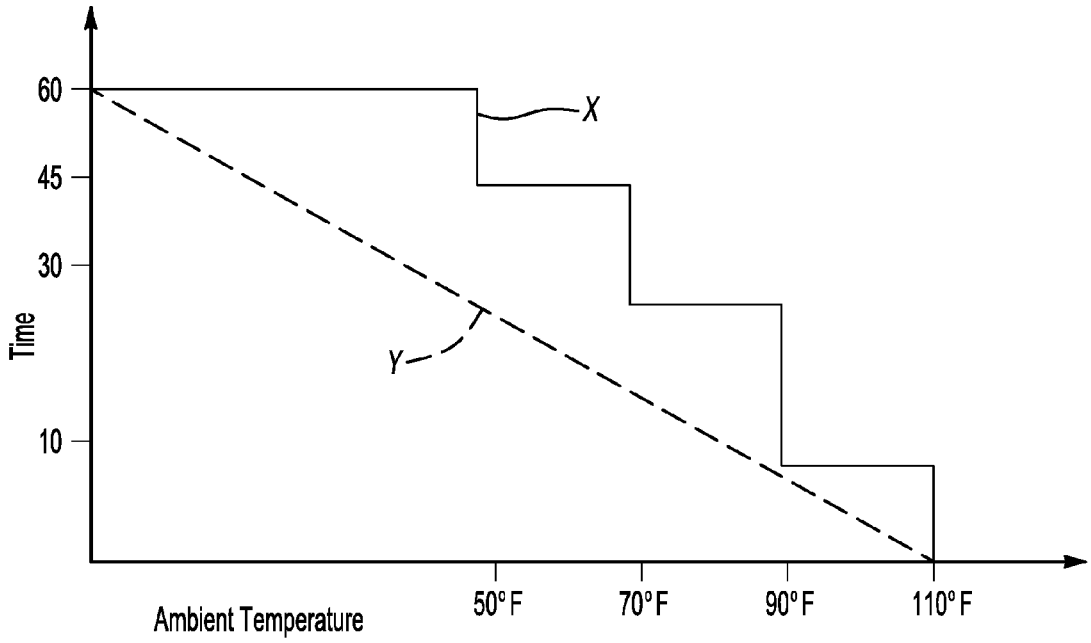
FIG. 4 is a graphical view of an embodiment of this invention.

As shown in FIG. 4, the present invention varies the time of reverse rotation dependent on ambient temperature. As shown in FIG. 2, an ambient temperature sensor 100 may be included in the refrigerant system and communicating with control 44.

As shown, a step function X is used, where the reverse rotation time changes in a step fashion with respect to the ambient temperature. At ambient temperatures below 50° F., for example, a time of one minute would be utilized. If the ambient temperature sensed is between 50 and 70°, a lesser time (45 seconds, for example) may be utilized. If an ambient temperature is between 70 and 90°, a lesser time (30 seconds, for example) may be utilized, while at ambient temperatures between 90 and 110°, a shorter reverse rotation time (10 seconds, for example) may be utilized. At ambient temperatures above 110° F., perhaps no reverse rotation at all is necessary. Of course, all of these quantities are simple examples. Any other time periods and temperature ranges can be used. By reducing the reverse rotation time as the ambient temperature is increased, the possibility of the motor or other compressor internal elements overheating during the reverse run is drastically reduced. Also the possibility of the motor tripping on the internal motor line break is minimized.

Alternatively, the time of reverse rotation can vary as a continuous function of the temperature, as shown by a function Y. For illustration purpose such function Y is shown as having a constant slope, though a function having a changing slope can be used for this purpose, if desirable.

In another embodiment, rather than varying the reverse rotation time based upon ambient temperature, other system conditions may be utilized. In particular, line voltage may be utilized to vary the time period. As an example, the reverse run time can be adjusted based upon the incoming voltage and operating frequency. The time may be decreased if the voltage is below a certain threshold and/or if the ratio of voltage/frequency is below a certain threshold. Additional fine tuning can adjust the reverse rotation time based on the combination of all three parameters, such as ambient temperature, voltage and frequency. Or a combination of any of the two parameters can be used for this purpose. The motor would tend to overheat more quickly at a reduced voltage and/or voltage/frequency ratio. Again, the variation of reverse run time based upon the voltage or voltage/frequency conditions can be changed in a stepped or continuous manner.

Of course, other parameters can be chosen to vary the time of reverse rotation, such as for example temperature and/or pressure measurements of the heat exchangers such as evaporator or condenser. The coil temperature of the heat exchanger on start up can be indicative of the compressor temperature and pressure inside the heat exchangers can be also indicative of the temperature inside the compressor or of the ambient temperature. The temperature sensor can be mounted externally or internally of the heat exchanger or associated piping. An internal temperature sensor can be mounted inside the compressor and the external temperature sensor can be mounted on the compressor shell.

Any adjustments with respect to reverse run time based on internal or external temperatures may be correlated to compressor motor temperature or temperature at any other location within the compressor when the compressor is running and thus may be used as another parameter to vary the time of reverse rotation. As motor temperature or temperature at other locations in the compressor is expected to increase the amount of reverse run time would decrease, whether in a stepped or continuous manner.

The refrigerant systems that utilize this invention can be used in many different applications, including, but not limited to, air conditioning systems, heat pump systems, marine container units, refrigeration truck-trailer units, and supermarket refrigeration systems.

A preferred embodiment of this invention has been disclosed, however, a worker of ordinary skill in the art would recognize that certain modifications come within the scope of this invention. For that reason the following claims should be studied to determine the true scope and content of this invention.

What is claimed is:

1. A compressor comprising: a motor and pump unit, said pump unit does not effectively compress fluid when rotated in one direction, but does compress fluid when rotated in an opposed second direction;

a control for determining that startup of the compressor is desirable;

said control rotating said motor in said one direction for a period of time, said period of time being varied based upon an ambient temperature condition; and said control stopping rotation in said one direction after the expiration of said period of time, and then beginning rotation in said second direction.

2. The compressor as recited in claim 1, wherein said compressor is of the type wherein a fluid passes into a sealed compressor shell and cools said motor as it is driven to an inlet of said pump unit, such that during rotation in said one direction, said fluid is not effectively passed over said motor and said motor heats quickly.

3. The compressor as recited in claim 1, wherein said pump unit is a scroll pump unit.

4. The compressor as recited in claim 1, wherein said pump unit is a screw pump unit.

5. The compressor as recited in claim 1, wherein the period of time is reduced as the ambient temperature condition increases.

6. The compressor as recited in claim 5, wherein said period of time is reduced incrementally.

7. The compressor as recited in claim 5, wherein said period of time is reduced continuously based upon an increase in ambient temperature.

8. A compressor comprising: a motor and pump unit, said pump unit does not effectively compress fluid when rotated in one direction, but does compress fluid when rotated in an opposed second direction;

a control for determining that startup of the compressor is desirable;

said control rotating said motor in said one direction for a period of time, said period of time being varied based upon a temperature of the compressor; and said control stopping rotation in said one direction after the expiration of said period of time, and then beginning rotation in said second direction.

9. A compressor comprising: a motor and pump unit, said pump unit does not effectively compress fluid when rotated in one direction, but does compress fluid when rotated in an opposed second direction;

a control for determining that startup of the compressor is desirable;

said control rotating said motor in said one direction for a period of time, said period of time being varied based upon a temperature of a heat exchanger or associated piping; and said control stopping rotation in said one direction after the expiration of said period of time, and then beginning rotation in said second direction.

10. A compressor comprising: a motor and pump unit, said pump unit does not effectively compress fluid when rotated in one direction, but does compress fluid when rotated in an opposed second direction;

a control for determining that startup of the compressor is desirable;

said control rotating said motor in said one direction for a period of time, said period of time being varied based upon a condition other than temperature; and said control stopping rotation in said one direction after the expiration of said period of time, and then beginning rotation in said second direction.

11. The compressor as recited in claim 10, wherein said period of time is changed based upon a system electrical condition.

12. The compressor as recited in claim 11, wherein said system electrical condition is at least one of a voltage and frequency.

13. The compressor as recited in claim 12, wherein said system electrical condition is an incoming line voltage.

14. The compressor as set forth in claim 12, wherein said system electrical condition is a ratio of voltage to frequency.

15. A method of operating a compressor comprising the steps of:

(a) providing a compressor including a motor and pump unit, said pump unit which does not effectively compress fluid when rotated in one direction, but does compress fluid when rotated in an opposed second direction;

(b) determining that startup of the compressor is desirable;

(c) initially rotating said motor in said one direction for a period of time, said period of time being varied based upon an ambient temperature condition; and (d) stopping rotation in said one direction after the expiration of said period of time and then beginning rotation in said second direction.

16. The method as recited in claim 15 wherein said compressor is of the type wherein a fluid passes into a sealed compressor shell and cools said motor as it is driven to an inlet of said pump unit, such that during rotation in said one direction, said fluid is not effectively passed over said motor and said motor heats quickly.

17. The method as recited in claim 15, wherein said pump unit provided in step (a) is a scroll pump unit.

18. The method as recited in claim 15, wherein said pump unit provided in step (a) is a screw pump unit.

19. The method as recited in claim 15, wherein the period of time is reduced as the ambient temperature condition increases.

20. The method as recited in claim 19, wherein said period of time is reduced incrementally.

21. The method as recited in claim 19, wherein said period of time is reduced continuously based upon an increase in ambient temperature, at least up until a predetermined ambient temperature limit.

22. A method of operating a compressor comprising the steps of:

(a) providing a compressor including a motor and pump unit, said pump unit which does not effectively compress fluid when rotated in one direction, but does compress fluid when rotated in an opposed second direction;

(b) determining that startup of the compressor is desirable;

(c) initially rotating said motor in said one direction for a period of time, said period of time being varied based upon a condition corresponding to temperature of the compressor; and (d) stopping rotation in said one direction after the expiration of said period of time and then beginning rotation in said second direction.

23. A method of operating a compressor comprising the steps of:

(a) providing a compressor including a motor and pump unit, said pump unit which does not effectively compress fluid when rotated in one direction, but does compress fluid when rotated in an opposed second direction;

(b) determining that startup of the compressor is desirable;

(c) initially rotating said motor in said one direction for a period of time, said period of time being varied based upon a condition corresponding to temperature of a heat exchanger or associated piping; and (d) stopping rotation in said one direction after the expiration of said period of time and then beginning rotation in said second direction.

24. A method of operating a compressor comprising the steps of:

(a) providing a compressor including a motor and pump unit, said pump unit which does not effectively compress fluid when rotated in one direction, but does compress fluid when rotated in an opposed second direction;

(b) determining that startup of the compressor is desirable;

(c) initially rotating said motor in said one direction for a period of time, said period of time being varied based upon a condition other than temperature; and (d) stopping rotation in said one direction after the expiration of said period of time and then beginning rotation in said second direction.

25. The method as recited in claim 24, wherein said period of time is changed based upon a system electrical condition.

26. The method as recited in claim 25, wherein said system electrical condition is at least one of a voltage and frequency.

27. The method as recited in claim 26, wherein said system electrical condition is an incoming line voltage.

28. The method as set forth in claim 26, wherein said system electrical condition is a ratio of voltage to frequency.

* * * * *